US006844311B2

(12) United States Patent
Ellson et al.

(10) Patent No.: US 6,844,311 B2
(45) Date of Patent: Jan. 18, 2005

(54) FABRIC CONDITIONING COMPOSITIONS

(75) Inventors: Karen Jane Ellson, Merseyside (GB); John Francis Hubbard, Merseyside (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 134 days.

(21) Appl. No.: 10/205,352

(22) Filed: Jul. 25, 2002

(65) Prior Publication Data

US 2003/0092591 A1 May 15, 2003

(30) Foreign Application Priority Data

Jul. 27, 2001 (GB) ..... 0118347

(51) Int. Cl.[7] ..... C11D 3/50
(52) U.S. Cl. ..... 510/527; 510/522
(58) Field of Search ..... 510/522, 527

(56) References Cited

U.S. PATENT DOCUMENTS

| | | | | |
|---|---|---|---|---|
| 4,162,984 A | | 7/1979 | DeBlock et al. | |
| 4,789,491 A | * | 12/1988 | Chang et al. | 510/525 |
| 5,525,245 A | * | 6/1996 | Grandmaire et al. | 510/524 |
| 5,792,219 A | * | 8/1998 | Hartman et al. | 8/137 |
| 5,854,201 A | | 12/1998 | Behler et al. | |
| 5,856,287 A | | 1/1999 | Motyka et al. | |
| 6,040,071 A | * | 3/2000 | Motyka et al. | 428/704 |
| 6,271,192 B1 | * | 8/2001 | Verstrat et al. | 510/527 |

FOREIGN PATENT DOCUMENTS

| | | |
|---|---|---|
| DE | 195 23 340 C1 | 3/1996 |
| DE | 19904233 | 8/2000 |
| EP | 0 829 531 A1 | 3/1998 |
| EP | 0 569 184 | 8/2000 |
| EP | 1 099 749 A2 | 5/2001 |
| WO | 93/19147 | 9/1993 |
| WO | 96/12002 | 5/1996 |
| WO | 97/03170 | 1/1997 |
| WO | 99/25797 | 5/1999 |
| WO | 99/42547 | 8/1999 |
| WO | 01/96510 A1 | 12/2001 |
| WO | 02/33032 A2 | 4/2002 |

OTHER PUBLICATIONS

UK Search Report for Application No. GB 0118347.4 dated Jan. 17, 2002.
WPI Acc. No. 2000–550256/200051 abstract of DE 199 04 233 A1 (Schreiber).
International Search Report No. PCT/EP 02/08064, dated Dec. 30, 2002, 3 pp.
WPI Derwent Abstract No. 1996–161217 of DE 195 23 340 C1.

* cited by examiner

*Primary Examiner*—John R Hardee
(74) *Attorney, Agent, or Firm*—Ellen Plotkin

(57) ABSTRACT

An aqueous, liquid fabric conditioning composition and a method for making such a composition are provided where the composition comprises a quaternary ammonium cationic softening compound and a non-ionic surfactant, where the composition comprises an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements. Use of a nonionic surfactant to improve the dispersibility in water of an aqueous, liquid fabric conditioning composition is also provided.

11 Claims, No Drawings

FABRIC CONDITIONING COMPOSITIONS

FIELD OF THE INVENTION

The present invention relates to fabric conditioning compositions, and in particular, to fabric conditioning compositions comprising emulsions having emulsion droplets with a mean diameter within a certain size range.

BACKGROUND OF THE INVENTION

Rinse added fabric conditioning compositions are well known. Typically, such compositions comprise aqueous lamellar phase dispersions which have fabric softening properties.

One of the problems frequently associated with conventional fabric conditioning compositions is that such compositions, especially those having a viscosity greater than about 0.08 Pa.s at a temperature of 25° C. at 106 $s^{-1}$, measured using a Haake rotoviscometer, exhibit poor dispersion, dissolution and deposition properties. This problem is made worse when there is little or no agitation of the water after the fabric conditioning composition has been added as is the case with handwashing.

It is desirable, that in addition to softening, fabric conditioning compositions have good dispersion, dissolution and deposition properties.

DE 199 04233 A1 discloses a solid premix for a laundry softening agent in which the dispersibility of the laundry softening raw material is said to be improved by adding, inter alia, a nonionic surfactant to a melt of the raw material and then milling the solidified melt. The resultant powder or granulate is then stirred into cold water to produce a laundry softening agent in the form of a dispersion which is ready for use. However, no evidence of improved dispersibility is provided and there is no disclosure of the formation of emulsions.

WO097/03170 discloses aqueous, concentrated, stable, water dispersible fabric softening compositions comprising a fabric softening active and a principal solvent selected from an extensive list. The molar ratio of the principal solvent to the fabric softening active is not less than 3, preferably from about 3.6 to about 100. However, the compositions disclosed are not emulsions.

EP-A-0569184 discloses a powder progenitive of a rinse conditioner which is used to form an aqueous dispersion of a rinse conditioner. There is no disclosure of any rinse conditioner formulations in the form of an emulsion.

WO93/19147 discloses fabric softening compositions which comprise a mixture of a diester quaternary ammonium fabric softener material, a highly ethoxylated hydrophobic material as a scum dispersant, and a liquid carrier. This mixture prevents the formation of scum caused by the interaction of the diester quaternary ammonium fabric softener material with anionic detergent surfactant and/or detergency builder entrapped in the fabric. However, the compositions disclosed are all dispersions, not emulsions.

OBJECTS OF THE INVENTION

The present invention seeks to address one or more of the above-mentioned problems, and, to give one or more of the above-mentioned benefits desired by consumers.

Surprisingly, we have found that the dispersion characteristics of a fabric conditioning composition comprising an aqueous emulsion formed from hydrophobic ingredients where the emulsion has droplets within a certain size range can be improved by the addition of low levels of a nonionic surfactant, especially an ethoxylated nonionic surfactant, even in poor agitation conditions.

SUMMARY OF THE INVENTION

According to the present invention there is provided an aqueous, liquid fabric conditioning composition comprising:

(i) a quaternary ammonium cationic softening compound; and (ii) a nonionic surfactant;

where the composition comprises an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements.

In another aspect, the invention provides a method of forming an aqueous, liquid fabric conditioning composition comprising:

(i) mixing with heating a quaternary ammonium cationic softening compound and a nonionic surfactant; and (ii) adding the mixture formed in (i) to water and milling so as to form a composition comprising an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements.

In a further aspect, the invention provides a method of forming an aqueous, liquid fabric conditioning composition comprising:

(i) mixing with heating a quaternary ammonium cationic softening compound and optional ingredient;

(ii) dispersing the mixture in water; and (iii) adding a nonionic surfactant with mixing so as to form a composition comprising an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements.

In yet a further aspect, the invention provides use of a nonionic surfactant to improve the dispersibility in water of an aqueous, liquid fabric conditioning composition comprising a quaternary ammonium cationic softening compound where the composition comprises an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements.

In the context of the present invention, the term "comprising" embraces "consisting of" and "including but not limited to". Thus, the ingredients or steps following the term "comprising" are not exhaustive.

DETAILED DESCRIPTION OF THE INVENTION

The present invention is concerned with aqueous fabric conditioning compositions which comprise emulsions.

In the context of the present invention, the term 'emulsion' means a liquid product which, at ambient temperature, is opaque, metastable, comprises droplets, or groups of droplets, of one immiscible liquid suspended in another liquid and which shows none of the signatures of a lamellar phase dispersion as evaluated by low angle x-ray diffraction and polarising light microscopy.

The term emulsion does not include conventional microemulsions which are clear and isotropic and which are thermodynamically stable across a specified temperature range.

Furthermore, it does not include conventional fabric conditioning compositions which consist entirely of aqueous lamellar phase dispersions. Aqueous lamellar phase dispersions consist of a suspension of a lamellar liquid crystalline phase in a liquid, in which the molecular packing of the suspended material results in a structure which exhibits long range order.

The compositions of the present invention may comprise a mixture of emulsion droplets and dispersions. These compositions are entirely different from conventional aqueous lamellar dispersions which are free of an emulsion component. For instance, unlike pure dispersions, mixed emulsion/dispersion compositions do not necessarily exhibit long range order.

In the context of the present invention, "long range order" means positional and orientational order of the structure in at least one direction. For an explanation of positional and orientational order, see "Introduction to Liquid Crystals", Chemistry and Physics, P. J. Collings and M Hird, printed 1997, reprinted 1998, p1.

Long range order can be verified by detection of Bragg peaks using low angle x-ray diffraction or by observing the composition in a polarising light microscope.

Preferably, the compositions of the present invention also comprise a perfume having a Clog P of 2 or more and an oily perfume carrier having a Clog P of 3.5 or more. In such compositions, it is believed that the hydrophobic perfume partitions into the oily perfume carrier and thus forms perfume carrier/perfume emulsion droplets. Without being bound by theory, it is believed that this is because in a mixed emulsion/dispersion system, it will be thermodynamically preferable for the specified hydrophobic perfume components to partition into the hydrophobic oily perfume carrier (forming emulsion droplets of perfume carrier/perfume) rather than into the dispersion phase.

In the rinse cycle of a wash, co-deposition of the mixture of the perfume carrier and perfume improves the efficiency of perfume delivery to and perfume retention on the fabric being treated.

The fabric conditioning compositions of the present invention comprising an emulsion or a mixture of emulsion and dispersion components (rather than a pure dispersion) are highly desirable because the emulsion (component) provides further benefits, particularly perfume delivery benefits and good lubrication of fabric treated with the composition.

Emulsion Droplet Sizes

In the composition, 80% or more by weight of the droplets in the emulsion have a mean diameter of from 0.4 to 60 microns, as measured using a Malvern particle size analyser, according to the method below. More preferably, 80% or more by weight of the droplets have a mean diameter of from 0.5 to 50 microns, most preferably from 0.6 to 30 microns, e.g. 0.6 to 35 microns.

Without wishing to be bound by theory, when a perfume and an oily perfume carrier are present, it is believed that the droplets, 80% or more by weight of which have a diameter of from 0.4 to 60 microns, as measured using a Malvern particle size analyser, are agglomerations of minute particles of the oily perfume carrier and perfume which comprise both individual oily emulsion particles/droplets and droplets which consist of flocs of flocculated oily emulsion particles/droplets.

Thus, in the context of the present invention, the term 'droplet' includes both individual oily emulsion particle/droplets as well as flocs of flocculated oily emulsion particles/droplets.

The nature of the emulsion droplets being measured will, of course, be apparent to the person skilled in the art using a Malvern particle size analyser and following the method of measuring droplet size, as set out below and correlating to measured droplet sizes with observations using a phase-contrast light microscope.

Method of Measuring Droplet Size

The emulsion droplet size is measured using a Malvern particle size analyser using a 45 mm lens for D[0,1] measurements and both a 45 mm and a 1000 mm lens for D[0,9] measurements. D[0,1] and D[0,9] readings denote droplet sizes which 10% by weight and 90% by weight respectively of the droplets are below.

The particle size analyser is a Malvern Mastersizer X.

A presentation code of 2LAD is used to reflect the average refractive index difference between oily droplets and water and between dispersed cationic softening compound lamellar phase particles and water.

Without wishing to be bound by theory, it is believed that the results obtained will be dependent at least partly on the lens selected since each lens will have maxima and minima measurement range and thus if particles outside of this range are present they may not be measured. Therefore, to ensure that the droplet mean diameter is within the mean diameter range of the invention, as measured using a 45 mm lens, it must be ensured that the emulsion does not comprise flocs of flocculated particles above the measurement capabilities of a 45 mm lens. Accordingly, a 1000 mm lens is used to confirm the D[0,9] measurement, using the 45 mm lens, so as to ensure that no large flocs (not registered using the 45 mm lens) are present in the emulsion.

ClogP Measurements

The hydrophobicity of the perfume and oily perfume carrier, if present, are measured by ClogP. ClogP is measured using the "ClogP" program (calculation of hydrophobicities as logp (oil/water)) version 4.01, available from Daylight Chemical Information Systems Inc of Irvine Calif., USA.

Quaternary Ammonium Cationic Fabric Softening Compound

The fabric conditioning composition of the present invention comprises one or more quaternary ammonium cationic fabric softening compounds.

It is preferred that the fabric softening compound(s) used is/are selected from those which are typically included in rinse-added fabric softening compositions.

The quaternary ammonium fabric softening compounds may have at least one ester group.

The cationic softening compounds may comprise quaternary ammonium compounds having two $C_8$–$C_{28}$ alkyl or alkenyl chains being directly attached to the nitrogen of the quaternary ammonium group.

Preferably, the average chain length of the alkyl or alkenyl group is at least $C_{14}$, more preferably at least $C_{16}$. Most preferably at least half of the chains have a length of $C_{18}$.

It is generally preferred that the alkyl or alkenyl chains are predominantly linear. An especially preferred type of cationic softening compound is a quaternary ammonium material which comprises a compound having two $C_{12-18}$ alkyl or alkenyl groups connected to the nitrogen head group via at least one ester link. It is more preferred if the quaternary ammonium material has two ester links present.

A first group of preferred ester-linked cationic softening compounds for use in the invention is represented by formula Formula (I)

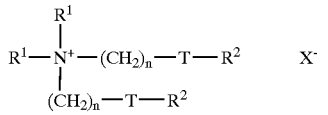

wherein each $R^1$ group is independently selected from $C_{1-4}$ alkyl or hydroxyalkyl or $C_{2-4}$ alkenyl groups; and wherein each $R^2$ group is independently selected from $C_{8-28}$ alkyl or alkenyl groups;

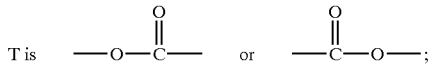

$X^-$ is any anion compatible with the cationic surfactant, such as halides or alkyl sulphates, e.g. chloride, methyl sulphate or ethyl sulphate and n is 0 or an integer from 1 to 5.

Especially preferred materials within this formula are di-alkenyl esters of triethanol ammonium methyl sulphate and N-N-di (tallowoyloxy ethyl) N,N-dimethyl ammonium chloride. Commercial examples of compounds within this formula are Tetranyl (trade name) AOT-1 (di-oleic ester of triethanol ammonium methyl sulphate 80% active), AHT-1 (di-hardened tallowyl ester of triethanol ammonium methyl sulphate 80% active), AO-1(di-oleic ester of triethanol ammonium methyl sulphate 90% active), L1/90 (partially hardened tallow ester of triethanol ammonium methyl sulphate 90% active), L5/90 (palm ester of triethanol ammonium methyl sulphate 90% active (supplied by Kao corporation) and Rewoquat WE15 ($C_{10}$–$C_{20}$ and $C_{16}$–$C_{18}$ unsaturated fatty acid reaction products with triethanolamine dimethyl sulphate quaternised 90% active), ex Goldschmidt Corporation.

A second preferred type of quaternary ammonium material is represented by formula (II):

Formula (II)

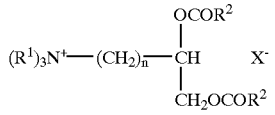

wherein $R^1$, $R^2$, n and $X^-$ are as defined above.

Preferred materials of this class such as 1,2 bis [tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A third preferred type of quaternary ammonium material is represented by formula (III):

Formula (III)

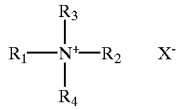

where $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Examples of compounds within this formula include di(tallow alkyl)dimethyl ammonium chloride, di(tallow alkyl) dimethyl ammonium methyl sulphate, dihexadecyl dimethyl ammonium chloride, di(hardened tallow alkyl) dimethyl ammonium chloride, dioctadecyl dimethyl ammonium chloride and di(coconut alkyl) dimethyl ammonium chloride.

It is advantageous for environmental reasons if the quaternary ammonium material is biologically degradable.

The cationic softening compounds are preferably present in an amount from 1.5 to 60% by weight of cationic surfactant (active ingredient) based on the total weight of the composition, more preferably 1.7 to 45% by weight, most preferably 2 to 31% by weight, e.g. 2.1 to 10% by weight.

The cationic softening compound may be substantially water insoluble. 'Substantially water insoluble' compounds in the context of this invention are defined as compounds having a solubility less than $1\times10^{-3}$ wt % in demineralised water at 20° C. Preferably the cationic softening compounds have a solubility less than $1\times10^{-4}$ wt %. Most preferably the cationic softening compounds have a solubility at 20° C. in demineralised water from $1\times10^{-6}$ to $1\times10^{-8}$ wt %.

Nonionic Surfactant

Suitable nonionic surfactants to act as dispersibility modifiers include addition products of alkylene oxide, especially ethylene oxide and/or propylene oxide, with fatty alcohols, fatty acids and fatty amines. The level of alkoxylation denotes the average number of alkoxy groups per molecule and is preferably from 8 to 35, more preferably from 10 to 25, most preferably from 11 to 22, e.g. 10 to 20.

Any of the alkoxylated materials of the particular type described hereinafter can be used as the nonionic surfactant. However, ethoxylated nonionic surfactants are preferred.

Suitable surfactants are substantially water soluble surfactants of the general formula:

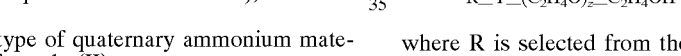

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, more preferably 11 to 18 and especially 12 to 16 carbon atoms.

In the general formula for the ethoxylated nonionic surfactant, Y is typically:

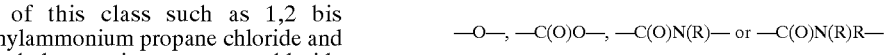

in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

Primary alcohol alkoxylates with an alkyl chain length in the alcohol of $C_{11-18}$, preferably $C_{12-16}$, and 1 to 20, preferably 1 to 15 and especially 3 to 15, alkoxylate groups are particularly suitable. Ethoxylate groups are particularly suitable as alkoxylate groups. The deca-, undeca-, dodeca-, tetradeca-, and pentadecaethoxylates of n-dodecanol, n-tridecanol and n-tetradecanol having an HLB within the range recited herein are useful dispersibility modifiers in the context of this invention. Exemplary ethoxylated primary alcohols useful herein as the dispersibility modifiers of the compositions are $C_{18}$ EO(10); and $C_{18}$ EO(11). The ethoxylates of mixed natural or synthetic alcohols in the "tallow" or "coco" chain length range are also useful herein. Specific examples of such materials include tallow alcohol-EO(11), tallow alcohol-EO(18), tallow alcohol-EO (25), coco alcohol-EO(10), coco alcohol-EO(15) and coco alcohol-EO (20).

B. Straight-Chain, Secondary Alcohol Alkoxylates

Secondary alcohol alkoxylates with an alkyl chain length in the alcohol of $C_{11-18}$, preferably $C_{12-16}$, and 1–20, preferably 1 to 15 and especially 3 to 15, alkoxylate groups are particularly suitable. Ethoxylate groups are particularly suitable as alkoxylate groups. The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful dispersibility modifiers in the context of this invention. Exemplary ethoxylated secondary alcohols useful herein as the dispersibility modifiers of the compositions are: $C_{16}$ EO(11); $C_{18}$ EO(11); and $C_{16}$ EO(14). Particularly preferred ethoxylated secondary alcohols are those sold under the trade names Tergitol 15-S-3, Tergitol 15-S-5, Tergitol 15-S-7 and Tergitol 15-S-9 (ex Union Carbide) which are all $C_{12-14}$ alcohols ethoxylated with an average of 3, 5, 7 and 9 ethoxylate groups respectively.

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the dispersibility modifiers of the instant compositions. The hexa- to octadeca-ethoxylates of p-tri-decylphenol, m-pentadecylphenol, and the like, are useful herein. Exemplary ethoxylated alkylphenols useful as the dispersibility modifiers of the mixtures herein are: p-tridecylphenol EO(11) and p-pentadecylphenol EO(18).

As used herein and as generally recognised in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the dispersibility modifiers of the instant compositions.

E. Branched Chain Alkoxylates

Branched chain primary and secondary alcohols which are available from the well-known "OXO" process can be ethoxylated and employed as the dispersibility modifiers of compositions herein.

The above ethoxylated nonionic surfactants are useful in the present compositions alone or in combination, and the term "nonionic surfactant" encompasses mixed nonionic surface active agents.

The nonionic surfactants may be present in the composition at low levels, preferably less than 2.0% by weight, based on the total weight of the composition. Preferably, the nonionic surfactant is present in an amount from 0.005 to 2% by weight, particularly 0.01 to 1.0% by weight and especially 0.05 to 0.5% by weight. Particularly preferred ranges for the nonionic surfactant are from 0.005 to 0.3%, more preferably 0.01 to 0.2% and especially 0.05 to 0.15%, by weight, based on the total weight of the composition.

Perfume Carrier

The perfume carrier is an oily substance having a ClogP of 3.5 or more, more preferably 6 or more, most preferably 8 or more. Especially preferred are water insoluble oils having a ClogP of 10 or more.

Any oily compound having a hydrophobicity, as defined by ClogP values, and which is thus compatible with the perfume is suitable for use as the carrier in the compositions of the present invention. By "compatible" is meant that the perfume carrier and the perfume form a liquid mixture (of emulsion droplets) at ambient temperature.

Preferably the perfume carrier has a slip point below 45° C., more preferably below 37° C. The slip point of a material is measured according to the definition as set out in British Standard BS684 section 1.3 1991 ISO 6321:1991 (UK).

Suitable oily perfume carrier materials include mineral/hydrocarbon oils, ester oils, sugar ester oils and/or natural oils such as vegetable oils. However, ester oils or mineral oils are preferred.

In the compositions of the present invention, the oily perfume carrier material is not a silicone oil and is preferably not a fluorocarbon oil.

The ester oils are hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include saturated ester oils, such as the PRIOLUBES (ex. Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable. Other suitable esters oils include fatty acid glyceride esters as defined in EP-A1-0746603, e.g. palm oil and tallow oil.

Suitable oily sugar ester compounds include the sugar ester oils defined in WO-A-98/16538, which are hereby incorporated by reference. The oily sugar esters preferably have a viscosity of from 5 to 50 Pa.s, and preferably have a density of from 0.8 to 1.2 $gcm^{-3}$, more preferably from 0.9 to 1 $gcm^{-3}$, most preferably from 0.93 to 0.99 $gcm^{-3}$.

It is preferred that the viscosity of the ester oil is from 0.002 to 2.0 Pa.S, more preferably from 0.004 to 0.4 Pa.s at a temperature of 25° C. at $106s^{-1}$, measured using a Haake rotoviscometer, and that the density of the mineral oil is from 0.8 to 0.9 $g.cm^{-3}$ at 25° C.

Suitable mineral oils include branched or straight chain hydrocarbons (e.g. paraffins) having 8 to 35, more preferably 9 to 20 carbon atoms in the hydrocarbon chain.

Preferred mineral oils include the Marcol technical range of oils (ex Esso) although particularly preferred are the Sirius range (ex Fuchs),the Semtol (ex. Goldschmidt), or the Merkur Tec range (ex Merkur Vaseline).

The molecular weight of the mineral oil is typically within the range 100 to 400.

One or more oils of any of the above mentioned types may be used.

It is believed that the oil provides excellent perfume delivery to the cloth and also increases perfume longevity upon storage of the composition.

The oil may be present in an amount from 0.1 to 15% by weight, more preferably 0.25 to 14%, by weight most preferably 1 to 10%, e.g. 2 to 9% by weight based on the total weight of the composition.

Perfume

The compositions of the invention may comprise one or more perfumes.

The perfume has a ClogP of 2 or more, more preferably 3 or more, most preferably 4 or more, e.g. 10 or more.

Suitable perfume ingredients having a ClogP of 2 include but are not limited to those disclosed in U.S. Pat. No. 5,500,137.

The perfume is preferably present in an amount from 0.01 to 10% by weight, more preferably 0.05 to 5% by weight, most preferably 0.07 to 2.5% by weight, based on the total weight of the composition.

For good perfume delivery to the fabric, it is desirable that the weight ratio of perfume to oily perfume carrier is from 1:50 to 2:1, more preferably 1:40 to 1:1, most preferably 1:20 to 1:2.

The perfume/perfume carrier emulsion droplets are preferably present at a level of 0.5 to 15% by weight, more preferably 1 to 10% by weight, most preferably 1.5 to 6% by weight, based on the total weight of the composition.

It is preferred that the weight ratio of the perfume/perfume carrier emulsion droplets to quaternary ammonium fabric softening compound is from 5:1 to 1:25, more preferably 4:1 to 1:15, most preferably 3:1 to 1:6.

Water

The compositions of the invention are aqueous based.

Typically, the level of water present is from 50–98% by weight, more preferably 60–97% by weight, most preferably 70–96% by weight, based on the total weight of the composition.

Co-active Softening Surfactants

Co-active softening surfactants for the cationic surfactant may also be incorporated in an amount from 0.01 to 20% by weight, more preferably 0.05 to 10%, based on the total weight of the composition. Preferred co-active softening surfactants are fatty acids, fatty esters, fatty alcohols, fatty amines and fatty N-oxides.

Preferred fatty acids include hardened tallow fatty acid, which may be present in an amount of from 0.1 to 20 wt %, based on the total weight of the composition.

Preferred fatty alcohols include hardened tallow alcohol, which may be present in an amount of from 0.01 to 10 wt %, more preferably 0.03 to 8 wt %, based on the total weight of the composition.

Preferred fatty esters include compounds having a fatty monoester component, such as glycerol monostearate (GMS). If GMS is present, then it is preferred that the level of GMS in the composition is from 0.01 to 10 wt %, based on the total weight of the composition.

It is particularly preferred that GMS is present in the compositions since it is believed that compositions comprising GMS have additional thickening, stabilising and softening benefits. However, for the purposes of the present invention, GMS is not an essential ingredient of the compositions of the invention.

Polymeric Thickeners

It is useful, though not essential, if the compositions comprise one or more polymeric thickeners. Suitable polymeric thickeners include nonionic and cationic polymers, such as hydrophobically modified cellulose ethers (e.g. Natrosol Plus, ex Hercules) or cationically modified starches (e.g. Softgel BDA and Softgel BD, both ex Avebe). Nonionic and/or cationic polymers are preferably present in an amount of 0.01 to 5 wt %, more preferably 0.02 to 4 wt %, based on the total weight of the composition.

The compositions of the invention are preferably free of polymers which are anionic or have an anionic nature (i.e. polymers which react in a way typical of anionic polymers).

Other Optional Ingredients

The compositions may also contain one or more optional ingredients conventionally included in fabric conditioning compositions such as pH buffering agents, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, insecticides, insect repellants, fungicides, antioxidants, sunscreens, anti-corrosion agents, drape imparting agents, anti-static agents, ironing aids and dyes.

Product Form

In its undiluted state at ambient temperature the product comprises a liquid emulsion or a mixture of an emulsion and a dispersion. Preferably the product comprises an emulsion of oily droplets alone or in combination with an aqueous cationic lamellar dispersion.

It is preferred that the product is free of solid particles.

Product Use

The composition is preferably used in the rinse cycle of a home textile laundering operation, where, it may be added directly in an undiluted state to the washing machine, e.g. through a dispenser drawer. Alternatively, it can be diluted prior to use. The compositions may also be used in a domestic hand-washing laundry operation.

Preparation

The compositions of the invention may be prepared according to any suitable method.

In a first preferred method, the quaternary ammonium cationic softening compound, nonionic surfactant, perfume carrier and optional co-actives, such as fatty acid and glycerol monostearate, are mixed in a premix vessel and heated to at least 5° C. above either the phase transition temperature of the softening compound or the melting point of the optional co-active so as to form a homogeneous premixture. Water is heated to between 35° C. and 70° C. in a separate vessel and is optionally blended with a pH buffering agent (e.g. phosphoric acid).

The premixture is then mixed with the water and milled with 2 batches or more per hour, more preferably 3 batches or more, passing through the mill. That is, preferably at least 86%, more preferably at least 95% of the batch passes through the mill at least once.

Alternatively, the premixture may be injected into the water in a recycle loop prior to passing through the mill, in which case 100% of the batch passes through the mill at least once.

The milled mixture is cooled to at least 5° C. below the phase transition temperature of the resulting mixture with optional further milling.

Perfume and optional ingredients are added (with milling/mixing, if necessary, to achieve a homogeneous composition).

In a further alternative, the nonionic surfactant may be added as a last step to the otherwise complete composition.

EXAMPLES

The invention will now be illustrated by the following non-limiting examples. Further modification within the scope of the present invention will be apparent to the person skilled in the art.

Examples of the invention are represented by a number. Comparative examples are represented by a letter.

Examples 1 to 4, A and B

The compositions of examples 1 to 4, A and B were prepared according to the method described above. The composition of Example A corresponds to that of a commercial product. The formulations are shown in Table 1 below.

TABLE 1

| Component | % by weight of active ingredient | | | | | |
|---|---|---|---|---|---|---|
| | 1 | 2 | 3 | 4 | A | B |
| DHTDMAC[1] | 2.20 | 2.20 | 2.20 | 2.20 | 3.80 | 2.20 |
| Fatty acid[2] | 0.38 | 0.38 | 0.38 | 0.38 | 0.38 | 0.38 |
| Perfume carrier[3] | 3.30 | 3.30 | 3.30 | 3.30 | — | 3.30 |
| GMS[4] | 0.10 | 0.10 | 0.10 | 0.10 | — | 0.10 |
| Perfume 1[5] | — | — | — | — | 0.30 | — |
| Perfume 2[6] | 0.30 | 0.30 | 0.30 | 0.30 | — | 0.30 |
| Tergitol 15-S-7[7] | 0.10 | — | 0.05 | 0.01 | — | — |
| Tergitol 15-S-3[8] | — | 0.10 | — | — | — | — |
| Minor ingredients | 0.11 | 0.11 | 0.11 | 0.11 | 0.11 | 0.11 |
| Water | to 100 | to 100 | to 100 | to 100 | to 100 | to 100 |

[1]dihardened tallow dimethyl ammonium chloride (e.g. Arquad2HT, ex Akzo)
[2]hardened tallow fatty acid (e.g. Pristerine 4981, ex Unichema)
[3]Semtol 70/28 is an animal feed grade hydrocarbon oil (ex Goldschmidt) with a ClogP greater than 12.
[4]glycerol monostearate (ex Cognis)
[5]Soft Touch MOD 178 (ex Givaudan Roure) with a ClogP greater than 2.
[6]Supra (ex Givaudan Roure) with a ClogP greater than 2
[7]secondary alcohol ethoxylate with an alkyl chain length of $C_{12-14}$ and an average of 7 ethoxylate groups (ex Union Carbide)
[8]secondary alcohol ethoxylate with an alkyl chain length of $C_{12-14}$ and an average of 3 ethoxylate groups (ex Union Carbide)

Subjective Pair Comparison of Product Properties

Method for Laboratory Evaluations

Trained panel of 12 people 15 g of each sample was placed in a glass jar. Panellists observed samples in pairs (full round robin paired comparison ie A v B; A v C etc) and stated preference for appearance and also gave comments. They then smelled each product and gave a vote of preference for each pair regarding smell, they also gave their opinion on the smell of the product.

Two large plastic bowls were used containing 4 liter of 20° C. Wirral water (approx. 15° French Hardness).

One sample was added to each bowl. Panellists made their preference choice regarding dispersion and also commented on the dispersion properties of the sample.

Gentle agitation was applied to the bowls for 15 seconds using a gentle hand motion. Panellists observed the bowl and stated their preference on the level of dispersion and again made comments where appropriate.

Results

Panel Test as Per Described Method for Samples A, B, 1 & 2

Preference Results:

(percentage preference scores)

TABLE 2

| | Smell in bottle | Appearance in bottle | Appearance in water | After agitation |
|---|---|---|---|---|
| A | 55 | 15 | 21 | 12 |
| B | 58 | 65 | 50 | 62 |
| 1 | 72 | 69 | 100 | 94 |
| 2 | 71 | 68 | 35 | 58 |

Panel Test as Per Described Method for Samples A, B, 3 & 4

Preference Results:

(percentage preference scores)

TABLE 3

| | Smell in bottle | Appearance in bottle | Appearance in water | After agitation |
|---|---|---|---|---|
| A | 30 | 8 | 11 | 8 |
| B | 73 | 82 | 79 | 45 |
| 3 | 57 | 70 | 73 | 100 |
| 4 | 58 | 79 | 69 | 70 |

The results in Table 2 show that the compositions of the invention were regarded as having a better smell and appearance in the bottle than the comparative examples. The composition of Example 1 was regarded as having a much better appearance in water, before and after agitation, than either of the comparative examples. The composition of Example 2 was considered to have a much better appearance in water, before and after agitation, than the commercial formulation of Example A and was considered to have a similar appearance in water after agitation to the composition of Example B.

The results in Table 3 show that both compositions of the invention were regarded as having a better smell and appearance in the bottle than the commercial formulation of Example A. In addition, the compositions of Examples 3 and 4 were both considered to have a much better appearance in water, before and after agitation, than the commercial formulation of Example A and were both considered to have a much better appearance in water after agitation than the composition of Example B.

These results therefore demonstrate the superior dispersibility, particularly in conditions corresponding to handwashing, of the compositions of the invention.

What is claimed is:

1. An aqueous, liquid fabric conditioning composition comprising:

(i) a quaternary ammonium cationic softening compound;

(ii) a nonionic surfactant;

(iii) a perfume having a ClogP of 2 or more; and (iv) an oily perfume carrier having a ClogP of 3.5 or more;

where the composition comprises an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements.

2. A composition according to claim 1 in which the quaternary ammonium cationic softening compound is a compound of the general formula Formula (III)

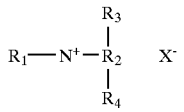

in which $R_1$ and $R_2$ each independently represent a $C_{8-28}$ alkyl or alkenyl group; $R_3$ and $R_4$ each independently represent a $C_{1-4}$ alkyl or $C_{2-4}$ alkenyl group; and $X^-$ is any anion compatible with the cationic surfactant.

3. A composition according to claim 1 in which the quaternary ammonium cationic softening compound is di(hardened tallow alkyl)dimethyl ammonium chloride.

4. A method of forming an aqueous, liquid fabric conditioning composition comprising:

(i) mixing with heating a quaternary ammonium cationic softening compound and a nonionic surfactant; and (ii) adding the mixture formed in (i) to water and milling so as to form a composition.

5. A method of forming an aqueous, liquid fabric conditioning composition comprising:

(i) mixing with heating a quaternary ammonium cationic softening compound and optional ingredients;

(ii) dispersing the mixture in water; and (iii) adding a nonionic surfactant with mixing so as to form a composition according to claim 1.

6. A composition according to claim 1, wherein the nonionic surfactant is present at a level of less than about 2.0% by weight, based on the total weight of the composition.

7. A composition according to claim 1, wherein the nonionic surfactant is present at a level of about 0.005% to about 2.0% based on the total weight of the composition.

8. A composition according to claim 1, wherein the nonionic surfactant is an addition product of an alkylene oxide and a fatty alcohol, fatty acid or fatty amine.

9. A composition according to claim 1, wherein the nonionic surfactant is a straight- or branched-chain primary or secondary alcohol alkoxylate, a straight- or branched-chain primary or secondary alkenyl alcohol alkoxylate or an alkyl phenol alkoxylate.

10. A composition according to claim 1, wherein the nonionic surfactant is a straight- or branched-chain primary or secondary alcohol ethoxylate.

11. A composition according to claim 1, wherein the nonionic surfactant is a straight- or branched-chain primary or secondary $C_{11-18}$ alcohol ethoxylated with an average of 8 to 35 ethoxylate groups.

* * * * *